United States Patent [19]

Everson

[11] Patent Number: 4,802,324

[45] Date of Patent: Feb. 7, 1989

[54] VERTICAL CARTONING ASSEMBLY AND METHOD

[75] Inventor: William G. Everson, Deerwood, Minn.

[73] Assignee: Minnesota Automation, Inc., Crosby, Minn.

[21] Appl. No.: 181,651

[22] Filed: Apr. 14, 1988

[51] Int. Cl.[4] ..... B65B 21/00; B65B 5/06; B65B 35/44

[52] U.S. Cl. ..... 53/398; 53/48; 53/251; 53/534; 53/579

[58] Field of Search ..... 53/48, 207, 242, 243, 53/251, 291, 398, 456, 458, 462, 467, 534, 564, 579, 585, 591; 493/312, 315, 318, 451

[56] References Cited

U.S. PATENT DOCUMENTS

| | | | |
|---|---|---|---|
| 1,852,790 | 4/1932 | Raymer et al. | 53/443 |
| 3,521,427 | 7/1970 | Masch | 53/48 |
| 3,627,193 | 12/1971 | Helms | 229/37 R |
| 3,698,151 | 10/1972 | Arneson | 53/26 |
| 3,751,872 | 8/1973 | Helms | 53/32 |
| 3,805,484 | 4/1974 | Rossi | 53/159 |
| 3,842,571 | 10/1974 | Focke et al. | 53/186 |
| 3,848,519 | 11/1974 | Ganz | 93/53 SD |
| 3,940,907 | 3/1976 | Ganz | 53/48 |
| 4,055,943 | 11/1977 | Reichert | 53/539 X |
| 4,100,715 | 7/1978 | Ganz | 53/48 |
| 4,642,975 | 2/1987 | Langen et al. | 53/564 |

FOREIGN PATENT DOCUMENTS

| | | | |
|---|---|---|---|
| 2122966 | 1/1984 | United Kingdom | 53/48 |

*Primary Examiner*—John Sipos
*Assistant Examiner*—Beth Tenney
*Attorney, Agent, or Firm*—Anthony G. Eggink

[57] ABSTRACT

A vertical cartoner assembly and method is for placing and assembling cartons over preselected product groups moved on a conveyor. The assembly has a frame structure having an elongated circular portion and vertically disposed drive shafts each having upper and lower chain sprockets. Continuous chains engage the upper and lower sprockets, and a power drive is provided to rotate one of the drive shafts. A continuous cam rail structure is mounted to the frame spacially intermediate the continuous chains. The continuous cam rail has downwardly and upwardly sloping sections. A plurality of vertical shafts are connected to the top and bottom chains. A carton holder body structure having a vertically disposed sleeve slidingly engages at least one of the vertical shafts. The carton holder body has a rearwardly extending cam follower for movement in the cam rail structure. The carton holder body structure has a pair of adjustable outwardly extending arms for receiving an opened and partially erected carton. The carton holder movement in the sloping rail section is in synchronization with the movement of the product groups on the conveyor and in alignment and spacially above and conveyor. A carton transfer device is provided for the continuous placement and opening of flat, folded cartons between the flight arms of the carton holder structures so that the movement of the carton holders provides for the vertical placement of cartons onto the preselected product groups.

20 Claims, 3 Drawing Sheets

VERTICAL CARTONING ASSEMBLY AND METHOD

BACKGROUND OF THE INVENTION

This invention relates to cartoner assemblies and methods for use in the packaging industry to package preselected product groups into cartons. Particularly, this invention relates to methods and cartoner assemblies which continuously place cartons in a vertical manner onto and over product groups being moved on a conveyor line.

The vertical cartoner assembly is designed to be used in synchronization with other packaging related equipment and cooperates with them to package preselected product groups during transport on a conveyor. Particularly, the vertical cartoner assembly of this invention is used to lower carton structures onto preselected groups of containers, such as bottles, to form packaged six-packs of beverages, for example.

In the past, cartons and containers such as bottles have been brought together or packaged in various manners. Typically, however, the bottles or individual product groups have been dropped into or placed onto partially opened or erected cartons in which they are ultimately packaged. Alternatively, the carton blanks are folded and constructed about the individual product groups and which generally requires the use of special carton structures as well as specialized, cooperating carton folding and constructing equipment. These prior art cartoners, due to their increased requirement of handling and constructing of each carton structure, have been limited in output capability, have been restricted in use and have been difficult and costly to maintain due to their respective complex designs.

Although some prior art devices have shown the lowering of carton structures, they have typically utilized mechanical clamps or vacuum cups. These devices have, as a result, functioned at relatively low speeds and have not been reliable in operation. And, although a need has existed in the packaging industry for an economical, compact, reliable and fast speed vertical cartoning structure, none insofar as is known has been disclosed or proposed.

The vertical cartoner assembly of this invention places opened or partially erected cartons or packaging units in a continuous and synchronized manner over preselected product groups as they are moved on a conveyor line. The cartoner assembly of this invention picks up and vertically places the partially erected cartons over the product groups, assembles or closes the cartons about the moving product groups and delivers packaged or finished cartoned units at the end of the assembly conveyor.

The vertical cartoning assembly provides for faster product handling, requires less floor space due to its compactness and provides for the gentle handling of the products, such as bottles, as a result of the vertical placement onto the product groups being moved on a conveyor line.

The vertical cartoning assembly further provides a synchronized and continuously functioning assembly which is adjustable to accomodate varying carton sizes and which is adaptable for use with other cooperating packaging related devices.

The vertical cartoning assembly and methods of this invention overcome the shortcomings and limitations of the prior art devices to yield assemblies and methods which permit the reliable and high speed vertical Placement of about 200 carton placements per minute onto product groups being transported on a conveyor line.

SUMMARY OF THE INVENTION

The vertical cartoner assembly is for placing cartons over preselected product groups that are being moved on a line conveyor. The vertical cartoner assembly has a frame structure of an elongated circular configuration and vertically disposed drive shafts each having an upper and a lower sprocket. Continuous chains are provided for respectively engaging the upper and lower sprockets, and drive means are provided to rotate the drive shafts.

A continuous cam rail structure is mounted to the frame structure intermediate the upper and lower continuous chains. The continuous cam rail has downwardly and upwardly sloping sections.

Further provided are a plurality of vertical shafts which are connected to the top and bottom chains. A carton holder structure having a vertically disposed slide bearing sleeve is provided for slidingly engaging at least one of the vertical shafts. The carton holder structure has a cam follower extending rearwardly for movement in the cam rail structure. Each carton holder further has a pair of adjustable, outwardly extending flight arms for receiving a partially erected and opened carton. The carton holder movement in the sloping cam rail section is in alignment, spacially above and in synchronization with the movement of the product groups on the conveyor.

A carton transfer device is provided for placing and opening partially erected cartons between the outwardly extending flight arms of the carton holder structure. The movement of the carton holder structure as a result of the continuous chains and the vertical movement by the cam follower tracking in the cam rail structure provides for the synchronized vertical placement of partially erected and opened cartons onto the preselected product groups on the moving conveyor for subsequent closure.

Also provided in the vertical cartoner assembly are alternate carton holder body structures to provide for packaging processes and assemblies to accommodate various carton sizes and configurations.

Also provided are methods for packaging product groups by vertically lowering partially erected and opened cartons onto and over moving products which are grouped and subsequently completely packaged.

These and other benefits of this invention will become clear from the following description, by reference to the drawings.

DESCRIPTION OF THE PREFERRED EMBODIMENTS

Figures 1, 2:
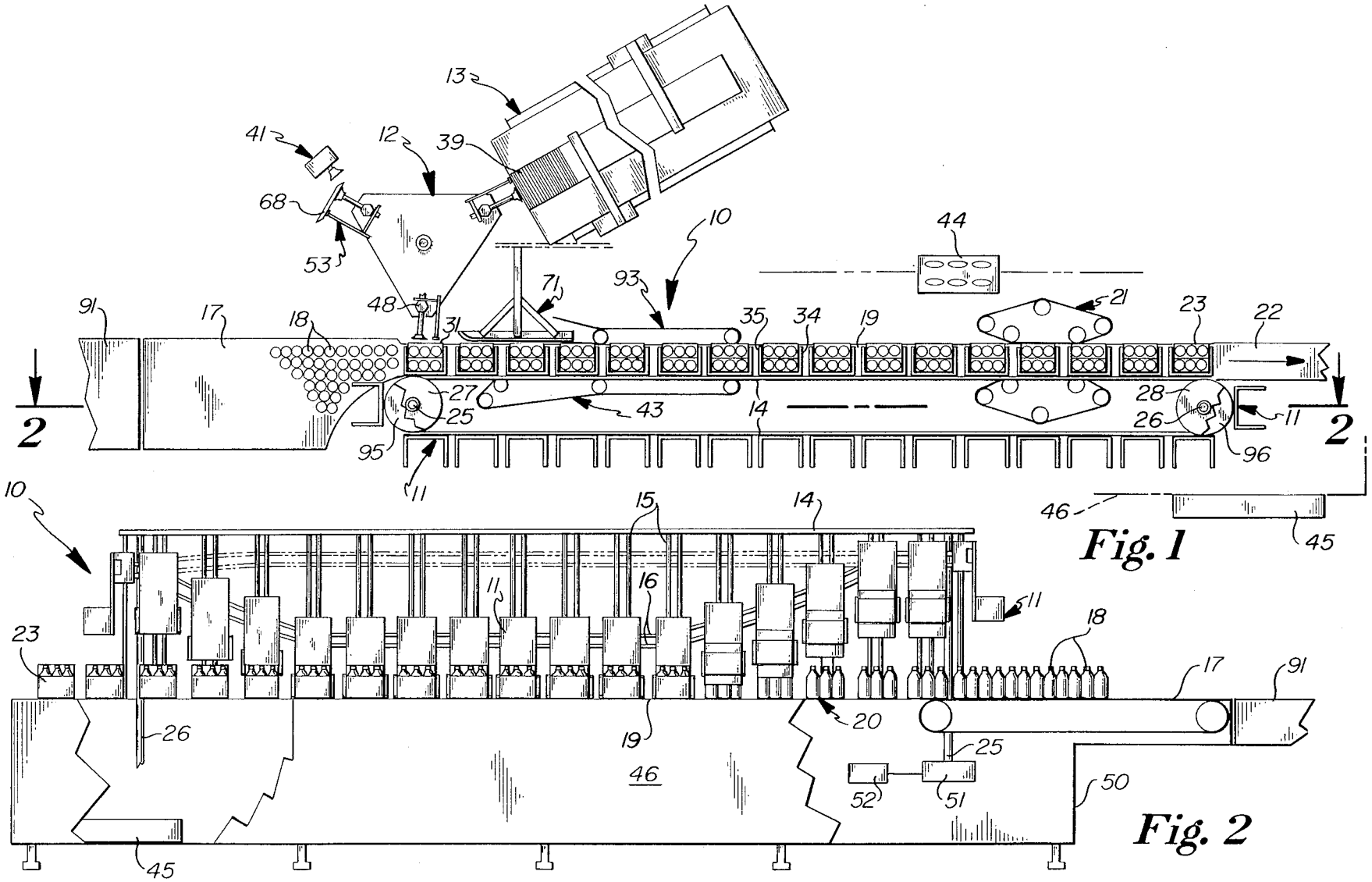
FIG. 1 is a top view of the vertical cartoner assembly of this invention in use with cooperating and associated packaging equipment.
FIG. 2 is a lateral schematic view of the vertical cartoner assembly shown in FIG. 1.

Referring to FIGS. 1 and 2, a vertical cartoner assembly 10 is shown having a line conveyor 19 in use with an infeed conveyor 17, a rotary carton placer 12 and an outfeed conveyor 22. The infeed conveyor 17 is used in conjunction and is in alignment with an existing product supply conveyor 91. The infeed conveyor 17 transports a flow of products such as containers or bottles 18 from the conveyor 91 to the line conveyor 19 of the cartoner assembly 10.

Figure 3:
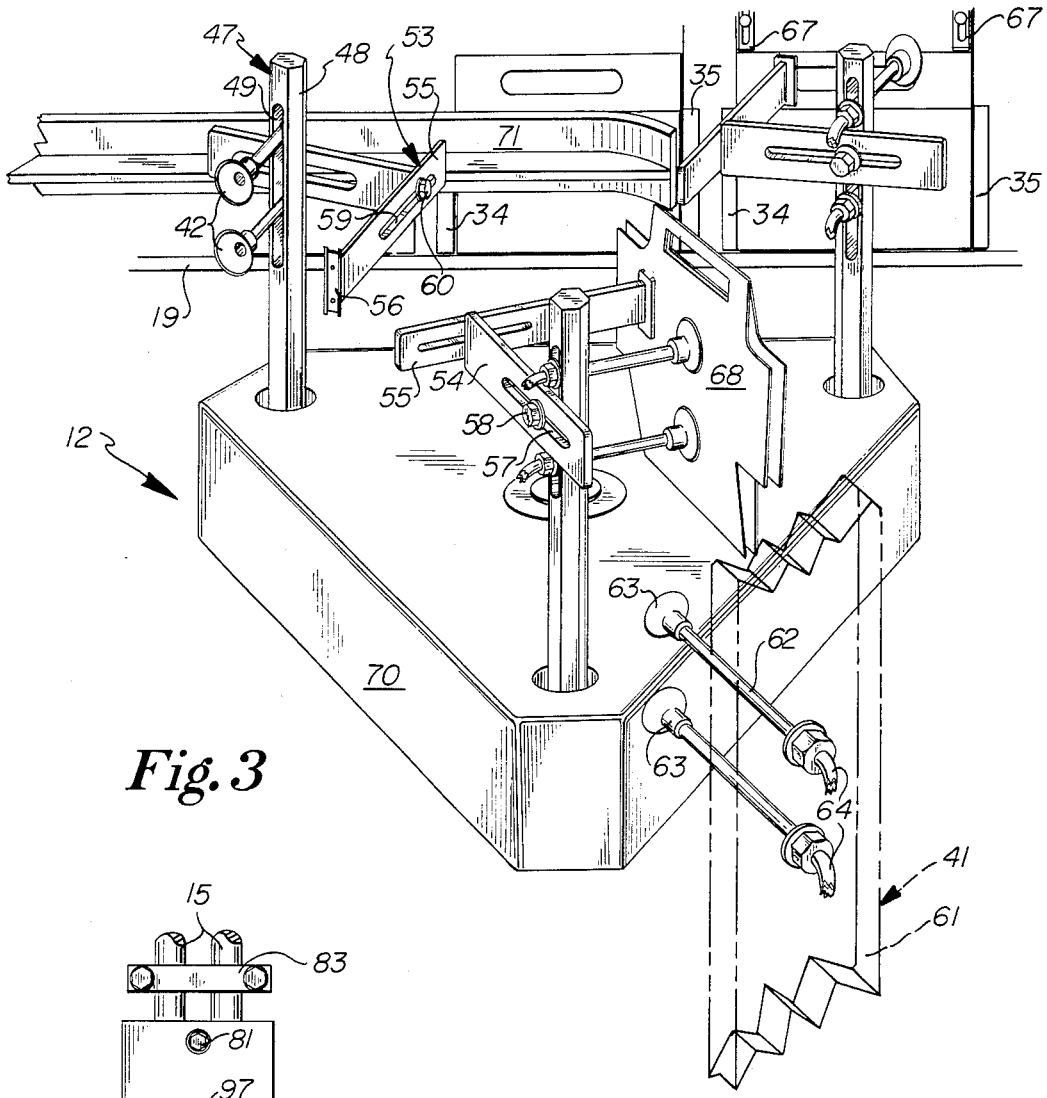
FIG. 3 is a perspective view of the carton transfer device used to place partially erected and opened cartons into the carton holder structures of the vertical cartoner assembly.

Rotary carton placers of the type shown are disclosed in Applicant's U.S. Pat. No. 4,530,686. However, the rotary carton placer 12, as shown in FIG. 1, is utilized in a horizontally disposed manner whereby the article transfer mechanisms 47, as shown in FIG. 3, removes individual flat and folded cartons from storage magazine 13, preferably a powered magazine, and transports and opens the individual cartons 39 into the carton holders 11 of the vertical cartoner assembly 10. The carton holders 11 vertically place the opened carton structures 31 onto the container or bottle groups 20 being moved on the line conveyor 19. Although a rotary carton placer is shown and described in this invention, other carton placement means may be utilized to insert partially erected and opened cartons into the pockets between the carton holder 11 flights. For example, chain driven, stationary pin and other mechanisms known in the art and used to drive article transfer mechanisms having vacuum cups may be used in synchronization with the vertical cartoner of this invention. However, speed, reliability and the use of cooperating and associated packaging devices may be reduced.

As disclosed in Patent '686, the carton placer device 12 operates by driving one or more planetary gear driven article transfer mechanisms 47 about a stationary gear located within enclosure 70 and causing them to travel in rotational paths having apex or exteriorally facing positions of travel. At these apex positions, various cooperating structures can be positioned, such as an article storage magazine 13. Also shown in FIG. 3, a prebreaker device 41 having vacuum cups 63 is placed at one such apex position of travel and to come into contact with the individual folded cartons 39 to partially open them prior to placement into the pocket between the flights 34 and 35 of the carton holders 11. The prebreaker device 41 is comprised of a support structure 61 having vacuum shafts 62 mounted thereon in a position whereby the vacuum cups 63 are in alignment with the carton 39 as it reaches an apex position of travel. Vacuum lines 64 are activated at timed sequences to temporarily cause the vacuum cups 63 to grasp the side of the carton 39 opposite that held by vacuum cups 42 of the carton placer 12, to thereby flex or break the creased folds in the carton. This process of partially opening the carton into a carton structure 68 aids the reliability of carton placement between the flights 34 and 35 of the carton holder 11.

As further shown in FIG. 3, an arm assist structure 53 is provided on each article transfer mechanism 47 to aid in the picking, transferring and Placing of the cartons. The arm assist structure 53 has a horizontal member 54 which is adjustably fixed by means of an elongated aperture 49 to the vacuum and support shaft 48 of the article transfer mechanism 47. Perpendicularly and adjustably fixed to the horizontal member 54 is an arm member 55 having a contact member 56 mounted at its end for engaging the cartons at various stages of carton movement. An adjustment slot 57 in member 54 with fastener 58 and adjustment slot 59 in member 55 with fastener 60 provides adjustability to the placement of contact member 56. The contact member 56 is preferably constructed of a smooth, hardened metallic composition or the like, so as to minimize carton scuffing and its placement is dependent upon carton size and structure. For example, the arm assist structure 53 aids in the removal of the cartons from the magazine 13 by contacting the removed individual flat folded carton; it aids in the pulling away of the partially opened carton at the prebreaker device 41; and it aids in placing or pushing the opened carton into the carton holder 11. Mounted on frame 50, a carton guide structure 71 is provided to further aid the placement of the opened carton 31 into the pocket of the carton holder 11.

FIG. 1 is a top view of the vertical cartoner assembly 10 within an enclosure 46, a frame structure 50 and which further shows the operation of the vertical cartoner 10 and its cooperation with the rotary carton placer 12, the line conveyor 19, a primary selector 43, a secondary product selector 93, and a carton folding or gluing mechanism 21. As known, the primary selector portion 43 provides the desired product count, i.e., 6 bottles on the line conveyor 19, while the secondary selector 93 provides for the proper spacing and timing of the product groups with respect to the movement and relative placement of the carton holders 11.

Although FIG. 1 shows one side of the vertical cartoner 10 being utilized to deposit cartons 31 onto the product groups 20 on line conveyor 19, it is within the purview of the invention to have a similar line conveyor 19, carton placer device 12 and related carton constructing equipment disposed on the opposite side of the assembly 10. In the latter configuration, the second line conveyor 19 would move product groups in the opposite direction. Although this arrangement may not normally be practical, under certain circumstances this double use arrangement may be desired.

FIG. 2 is a lateral view of the assembly 10 which further shows the vertical cartoner assembly 10 having a number of carton holders 11 which are slidably attached to vertical shafts 15 which are fixed to and rotated by means of continuous chains 14 and 29 in a cylindrical fashion, like a carousel. The carton holders 11, as will be further discussed, are slidingly attached to the vertical shafts 15 to form a continuous movement of carton holders 11 which obtain the cartons from the carton placer device 12. The pair of continuous chains, namely top chain 14 and bottom chain 29 are driven by rotating top gears 27 and 28 and spacially disposed bottom gears which are driven by drive shafts 25 and 26.

As further shown in FIGS. 1 and 2, drive shaft 27 is connected to a drive and synchronization mechanism 51 which is driven by drive means or motor 52. This arrangement is utilized whereby the drive shaft 27, the rotary placer 12 and the line conveyors are all driven by a common line shaft to thereby synchronize the movement and operation of the assembly 10. An electrical station 45 and an operator station 44 are provided to permit the operator to control the vertical cartoning assembly, its vacuum controls, the various conveyors and the operation of associated devices.

Figure 7:
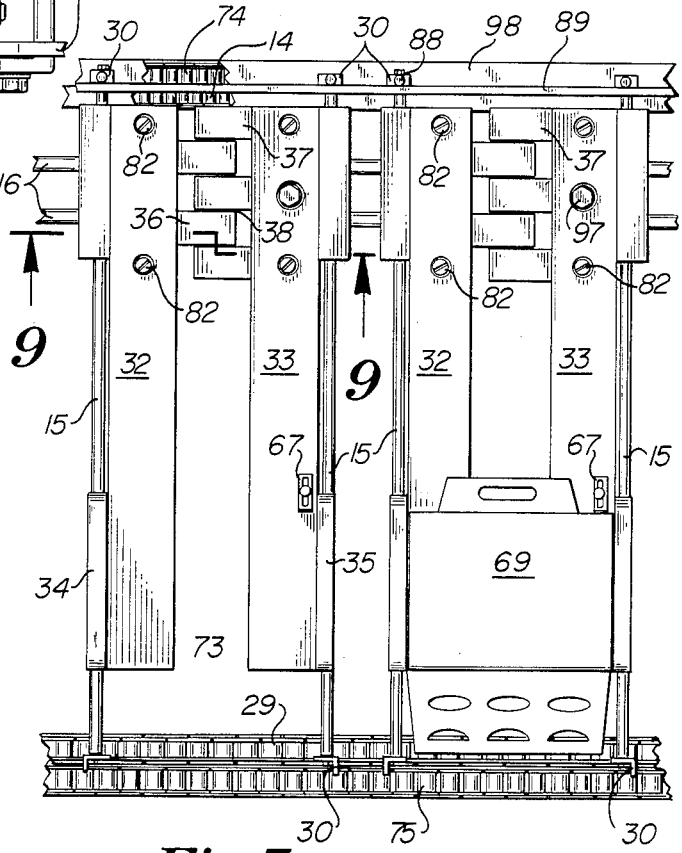
FIG. 7 shows an alternate embodiment of a two-part carton holder of this invention.

Each carton holder structure 11 has a cam follower 24 and moves up and down on the shafts 15 by means of the cam follower's engagement with the cam rail or track structure 16. The cam track structure 16 is likewise a continuous structure which is generally spacially perpendicular to the movement of the carton holders 11. As shown particularly in FIG. 2, the cam structure or cam track 16 has a downwardly sloping section which causes each carton holder 11 to move downward toward the line conveyor 19 for purposes of depositing an erected and opened carton and, thereafter, moves upward as a result of the upwardly sloping cam structure section. Thus, as the chain 14 is rotated by means of rotating shafts 25 and 26 and drive gears 27 and 28, the cam structure 16 causes the carton holder 11 to move vertically at predetermined locations with respect to the rotary carton placer 12 and the carton folding or gluing mechanism 21 as the bottles or containers groups 20 are moved on line conveyor 19. As the opened cartons 69, as shown in FIG. 7, are transported downstream, the flaps of the cartons can be guided outward by structures known in the art to ensure the unencumbered placement of the cartons 69 over the moving product groups 20. Prior to reaching the carton and gluing station or mechanism 21, the flaps are released from this position and directed in a position for carton closure. A carton folding or gluing mechanism 21, known in the art, or any particular folding or gluing mechanism is provided with the assembly depending upon the style of cartons being utilized. The mechanism 21 essentially being utilized to complete the assembly or construction of the opened carton, for example, by gluing or intermeshing the tabs of the carton bottom flaps.

Figure 4:
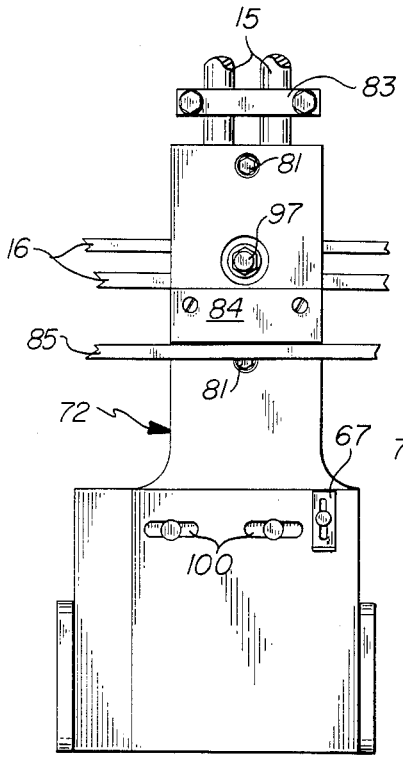
FIG. 4 is a frontal view of a unitary carton holder embodiment of this invention.
Figure 6:
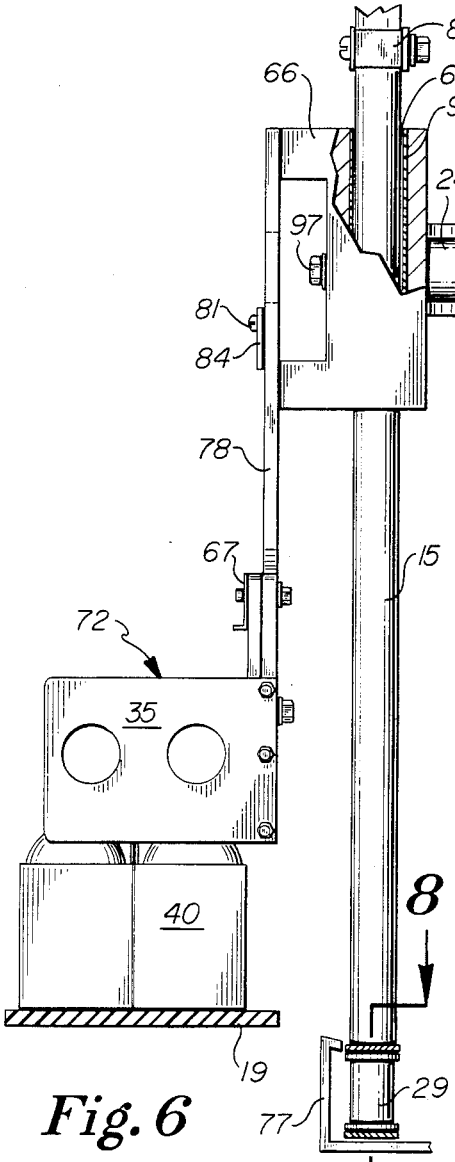
FIG. 6 is a lateral view of the unitary carton holder embodiment of FIG. 4.

FIGS. 4 and 6 show a front and lateral view of a unitary carton holder or basket embodiment 72. The carton holder body 72 is adjustable so that the respective flights 34 and 35 can be moved with respect to one another by means of adjustment slots 100 to accommodate various size cartons. Thus, by adjusting the fasteners or bolts 81, the flight portions 34 and 35 can be adjusted with respect to each other to change the spacing between them. As further shown, the unitary carton basket 72 has a basket stabilizing member 83 disposed at the top. This stabilizing member 83 is connected to the vertical shafts 15 so that the overall carton holder structure is stable. Additionally, the carton basket 72 is shown to have a slide bar 84 which is a member composed of a nylon strip or the like which slidingly engages the guide bar 85, which is attached to frame 50. The latter structure further ensures that the cartons held by the basket are disposed at a uniform distance above the line conveyor 19. The carton holders are also provided with a carton alignment structure 67, such as an adjustable bracket, to engage the top of the carton structure 69 so that it is fixed in the carton basket. The latter being particularly useful as the carton holder is moved downward over the container groups 20.

Figure 8:
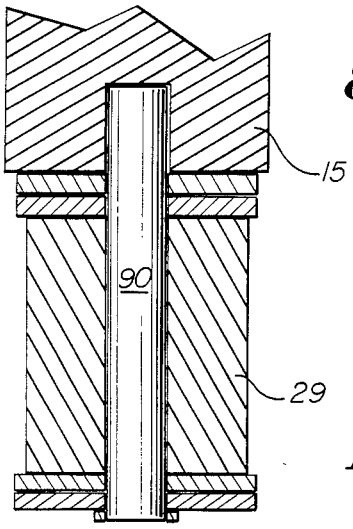
FIG. 8 is a cross-sectional view taken along lines 8-8 in FIG. 6 and showing the attachment of the vertical shaft to the lower chain.

FIG. 8 is a cross-sectional view showing the attachment of the vertical shafts 15 to the lower chain 29 in conjunction with the unitary carton basket structure 72. As shown, the chain 29 has an elongated pin 90 which protrudes from the top of the chain to engage and fit into an elongated aperture in the vertical shaft 15. A similar arrangement is utilized with respect to the attachment of the vertical shafts 15 to the top chain 14.

FIGS. 6 and 7 shows alternate embodiments of the carton holders 11, and further show the connection and operation of the carton holder structure 11 with respect to top chain 14 and bottom chain 29 as well as to the cam structure 16. The carton holder 11 has a connecting body structure 66 having a cylindrical opening or sleeve 65 to slidingly engage the vertical shaft 15. Preferably, a bushing 92 is fixed within the sleeve 65. Mounted to the connecting structure 66 is a basket support structure 78. Each carton holder 11 has a pair of outwardly extending flight arms 34 and 35 which holds an opened erected carton 69 therebetween and in position over the product groups 20 on line conveyor 19. As shown, a cam follower 24 is attached at the rear of each carton holder 11 by fastener 97 and placed in a position for movement within the cam structure or track 16 which is connected to frame 50 by clamp attachment 99. The cam follower has a bearing assembly and is constructed of a hardened metallic composition. Therefore, as the vertical shafts 15 are moved by the moving chains 14 and 29, the movement of the cam follower 24 in track 16 cause the carton holder structures 11 to move in a vertical manner. The bottom chain 29 is driven by bottom gears rotated by drive shaft 25 and 26, and the lower chain 29 is supported and guided by channel structure 77.

Figure 5:
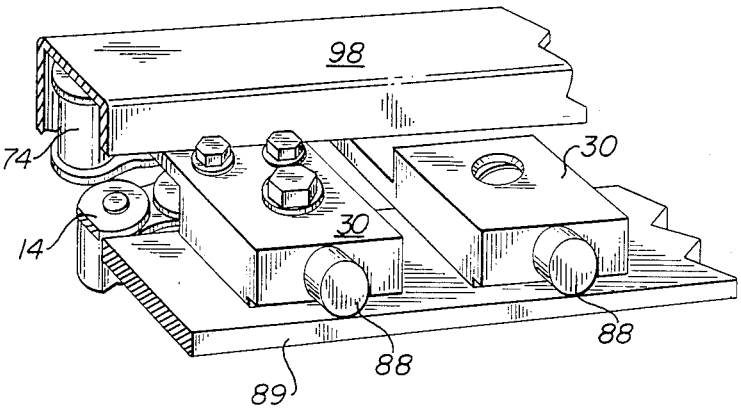
FIG. 5 shows the chain connectors used to attach a two-part carton holder embodiment to a pair of top chains.

Referring further to FIG. 7, the carton holder 11 is shown having a body structure 73 comprised of two interleaved carton flight bodies 32 and 33 having flight arms 34 and 35. Each flight body is slidably mounted on a vertical shaft 15 and each is separately connected to top chains 14 and 74 and to bottom chains 29 and 75 by means of chain connectors 30 which are further shown in FIG. 5. Although the shafts 15 can be attached to the respective chains as shown in FIG. 8, they can also be attached by means of brackets to the connectors 30, which additionally are shown to have bearing rollers 88 which roll on track plate 89 to support the chain structures and the connected shafts 15. The carton flight bodies 32 and 33 are mounted to the brackets by means of fasteners 82. The track 89 is attached to frame structure 50 and, as further shown, a chain cover and guide structure 98 is provided for the top chains. As further shown in FIG. 1, a pair of top gears 28 and 27 are utilized to drive continuous chain 74, for example, while top gears 95 and 96 drive continuous chain 14. A similar bottom gear arrangement is also utilized in this embodiment so that the leading carton flight bodies 32 and the trailing carton flight bodies 33 are connected to alternate chains 14 and 74.

Thus, each carton flight structure 32 and 33 is connected to a separate upper and lower chain which permits the pockets to be opened or closed by means of the respective movement of the chain sprockets to adjust the spacing between the flight structures 32 and 33. The leading carton flight 32 has a cam follower 24 attached at its rear so that its movement is controlled by the configuration of the cam structure 16. The flight structure 33 will follow the structure 32 because they are meshingly connected. This particular two-piece carton holder structure 11 permits the operator of the vertical cartoner to move forward or rearward the respective top and bottom chains to thereby adjust the spacing between flight arms 34 and 35 to accommodate various size cartons 31.

Figure 9:
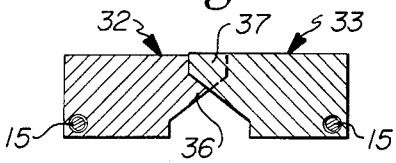
FIG. 9 is a cross-sectional view of the top portion of the carton holder of FIG. 7.

As further shown in FIG. 9, leading carton flight 32 is shown to have flight pivot structures 36 which slidably interlock with opposing flight pivot structures 37 of the trailing carton flight 33. Thus, as the carton holder 11 moves circularly about the rotating shafts 25 and 26, the carton flights 32 and 33 pivot in an interlocking manner. Bearing surfaces 38, such as nylon, are provided to aid the slidable engagement between flight pivot structures 36 and 37.

As previously discussed, FIG. 6 shows a unitary embodiment of the carton holder 11 and which is used with a single top chain 14 and bottom chain 29. This particular carton holder is a one-piece or unitary carton holder structure. Unlike the carton holder previously described having carton plates 32 and 33, and having the flight pivot structures 36 and 37, this particular embodiment is unitary in structure. One upper chain 14 and one lower chain 29 is utilized in the vertical cartoner assembly using this embodiment. Although the two-piece carton holder 11 has the advantage of being more quickly adjustable to accommodate various carton dimensions, the carton holder embodiment shown in FIGS. 4 and 6 has elements, as discussed, which permit the mechanical adjustment of each individual carton holder for Purposes of accommodating different size cartons.

In operation, as a carton holder 11 approaches the rotary carton placer 12, a carton in a flat and folded configuration 39 is removed from magazine 13 and placed and opened between the flight arms 34 and 35 of the carton flights 32 and 33. As the opened and erected carton 31 is moved in synchronization with and above the group of bottles or containers 20 being carried on line conveyor 19, the cam structure 16 causes the opened carton 31 to be moved downward and over the group of bottles 20. In conjunction with a carton folding mechanism or gluing station 21, the carton 31 is folded or constructed into a finished configuration 40 to yield the packaged product 23.

In summary, the process of this invention for vertically lowering partially erected cartons onto the preselected moving product groups is comprised of the following steps. First, a line conveyor is provided for moving the preselected product groups through a cartoner assembly having a frame structure and a continuous supply of carton receiving baskets which lower the cartons onto the moving product groups. Next, a supply of folded cartons is provided for the cartoner assembly. The individual cartons are then removed from the carton supply and into the carton holders in an opened and erected state by the transfer device. The carton baskets are then guided and lowered in synchronization onto the moving product groups, after which the partially erected cartons are sealed or constructed and removed from the line conveyor.

As many changes are possible to the embodiment of this invention, utilizing the teachings thereof, the description above and the accompanying drawings, should be viewed in the illustrative and not in the limited sense.

That which is claimed is:

1. A vertical cartoner assembly for placing cartons over preselected product groups being moved on a conveyor comprising:

(a) a frame structure having an elongated circular portion with two ends, a pair of vertically disposed and opposing drive shafts each having upper and lower sprockets and being located at said circular end portions, a top and bottom continuous chain for engaging said upper and lower sprockets, and drive means to rotate one of said drive shafts, (b) a continuous cam rail structure mounted to said frame structure intermediate said continuous chains, said continuous cam rail structure having downwardly and upwardly sloping sections, (c) a plurality of vertical shafts connected to said top and bottom chains, (d) a carton holder body structure having at least one vertically disposed sleeve for slidingly engaging at least one said vertical shaft, said carton holder body further having a cam follower mounted to the rear thereof for movement in said cam rail structure, said body structure further having a pair of outwardly extending flight arms for receiving a partially opened carton, said carton holder movement in said sloping rail section being aligned spacially above and in synchronization with the product groups on the conveyor, and (e) a carton transfer device for placing and opening carton blanks between the outwardly extending arms of said carton holder body structure, whereby the downward movement of said carton holder structures as a result of said cam follower movement in said cam rail structure and the movement of said upper and lower sprockets provides for the vertical placement of opened cartons onto the preselected product groups on the moving conveyor.

2. The vertical cartoner assembly of claim 1, wherein said carton holder body structure is unitary and has means to adjust said outwardly extending flight arms.

3. The vertical cartoner assembly of claim 2, wherein said frame structure has a pair of upper and lower sprockets and a pair of upper chains and lower chains and wherein said carton holder body structure has a pair of sleeves for slidingly engaging adjacent vertical shafts.

4. The vertical cartoner assembly of claim 3, wherein said carton holder body is a two part structure having interleaved upper members and wherein each said upper and lower chains are moveable with respect to each other for adjusting the spacing between the flights of the carton holder body structure.

5. The vertical cartoner assembly of claim 1, wherein a carton closing mechanism is located adjacent the conveyor and below said downwardly sloping section of said cam rail structure.

6. The vertical cartoner assembly of claim 1, wherein the carton transfer device is a rotary transfer device having at least one article transfer mechanism.

7. The vertical cartoner assembly of claim 1, wherein the carton transfer device has a prebreaker device located at one of its apex positions of travel.

8. The vertical cartoner assembly of claim 6, wherein said rotary transfer device has an adjustable arm assist structure mounted on its article transfer mechanisms.

9. A cartoner assembly for placing cartons vertically onto a moving stream of preselected product groups comprising:

(a) a frame structure having drive means mounted thereon, (b) opposing top and bottom sprockets having rotatable vertically disposed shafts, one said shaft being driven by said drive means, (c) continuous chains in communication with said top and bottom sprockets, (d) a continuous cam rail structure located spacially intermediate said continuous chains, said rail structure having downwardly and upwardly sloping sections, (e) a plurality of vertical shaft pairs respectively connected to said top and bottom chains, (f) a plurality of basket structures with outwardly extending flight arms slidingly mounted on said vertical shafts and having a cam follower extending from the rear thereof for placement and movement in said cam rail structure, and (g) a carton transfer device for the placement of cartons between the flight arms of said baskets structures.

10. The cartoner assembly of claim 9, wherein said device has a pair of opposing top and bottom sprockets, and a pair of top and bottom chains and wherein said basket structures are comprised of two-piece bodies, said basket bodies being interleaved and each said corresponding two-piece body being connected to the same top and bottom chain.

11. The cartoner assembly of claim 9, wherein each said basket structure is constructed of an adjustable unitary basket body, each said unitary basket body having adjustment means to accommodate various size cartons.

12. The cartoner assembly of claim 9, wherein said carton transfer device is a rotary transfer structure.

13. The cartoner assembly of claim 9, wherein the rotary transfer device has a prebreaker device located at one of its apex positions of travel.

14. The cartoner assembly of claim 9, wherein said rotary transfer device has an adjustable arm assist structure mounted on its article transfer mechanism.

15. A process for vertically lowering partially erected and opened cartons onto moving preselected product groups comprising:

(a) providing a line conveyor for moving preselected product groups, (b) providing a cartoner assembly having a frame, a carton transfer device, a cam rail structure having sloping sections, and a continuous supply of carton receiving baskets for engagement with said cam rail structure and for lowering cartons onto the product groups, (c) providing a supply of flat and folded cartons for said cartoner assembly, (d) placing individual cartons from said carton supply into the carton holders of said cartoner assembly, (e) lowering and guiding said carton baskets onto the moving product groups, (f) sealing the cartons beneath said product groups, and (g) removing the cartoned products from the line conveyor.

16. The process of claim 15, wherein said cartoner assembly is provided having unitary carton receiving baskets.

17. The process of claim 15, wherein said cartoner assembly is provided with two-piece adjustable carton receiving baskets.

18. The process of claim 15, wherein said carton transfer device is a rotary transfer device having article transfer mechanisms.

19. The process of claim 18, wherein said carton transfer device is provided with a prebreaker device at an apex position of travel of said article transfer mechanism.

20. The process of claim 18, wherein said carton transfer device is provided with an arm assist structure mounted on said article transfer mechanism.

* * * * *